United States Patent [19]

Magoon et al.

[11] 4,300,856

[45] Nov. 17, 1981

[54] COMPACTABLE, FOLDABLE, FLOATABLE, BOOM-FENCE TO QUICKLY CONTROL THE SPREAD OF CONTAMINATES OVER WATER SURFACES

[76] Inventors: Richard E. Magoon, 1337 Regents Blvd., Apt. C; Lester E. Magoon, 8545 27th St. West, both of Tacoma, Wash. 98466

[21] Appl. No.: 82,776

[22] Filed: Oct. 9, 1979

[51] Int. Cl.[3] ..... E02B 15/04

[52] U.S. Cl. ..... 405/66; 405/70; 405/72

[58] Field of Search ..... 405/63, 66, 70, 71, 405/72

[56] References Cited

U.S. PATENT DOCUMENTS 3,744,253 7/1973 Williams et al. ..... 405/70 X 3,868,824 3/1975 Thurman ..... 405/71

FOREIGN PATENT DOCUMENTS 2402037 4/1979 France ..... 405/70

*Primary Examiner*—David H. Corbin

*Attorney, Agent, or Firm*—Roy E. Mattern, Jr.

[57] ABSTRACT

A compactable, foldable, floatable, continuous, boom-fence is quickly and readily launched, often from the deck of a boat, via accordian-like folded sections, in turn quickly interconnected to like sections, to form an overall boom-fence projecting above the water surface, while also depending below the water surface, thereby creating a water boom to fence a large water surface area during the control of a contaminate unwantedly spreading over a surface of water. Each section of the boom-fence comprises planar rectangular fence panels flexibly secured together with flexible coupling panels and cable, and provided with both planar buoyant materials and planar retractable hinged dampening fins, tending to keep the planar rectangular fence panels upright during their deployment, when confronted with forces created by waves, wind, and tides or currents.

In a preferred embodiment the planar rectangular fence panels are made of sheet metal having their tops folded over a continuous cable, having their bottoms equipped with foldable, hinged, oppositely positioned sheet metal dampening fins held in their active dampening positions by stiffleg springs, having planar rectangular foam floats attached to each side of the fence panels nearer their top than their bottom, and having each end of each fence panel secured to a flexible coupling made of coated fiberglass cloth and between sections composed of several panels, Velcro fasteners join the midsection of such a flexible coupling, where also cable connectors are utilized.

17 Claims, 13 Drawing Figures

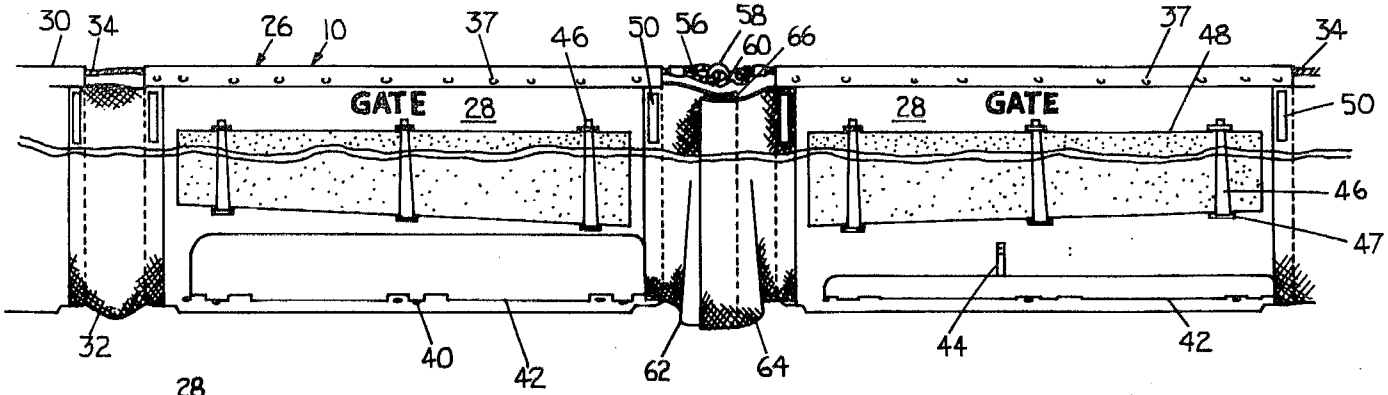
FIG. 7
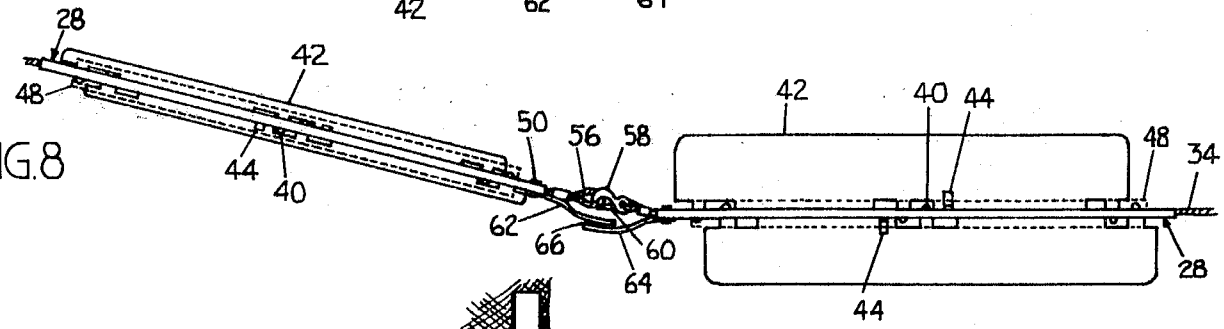
FIG. 8
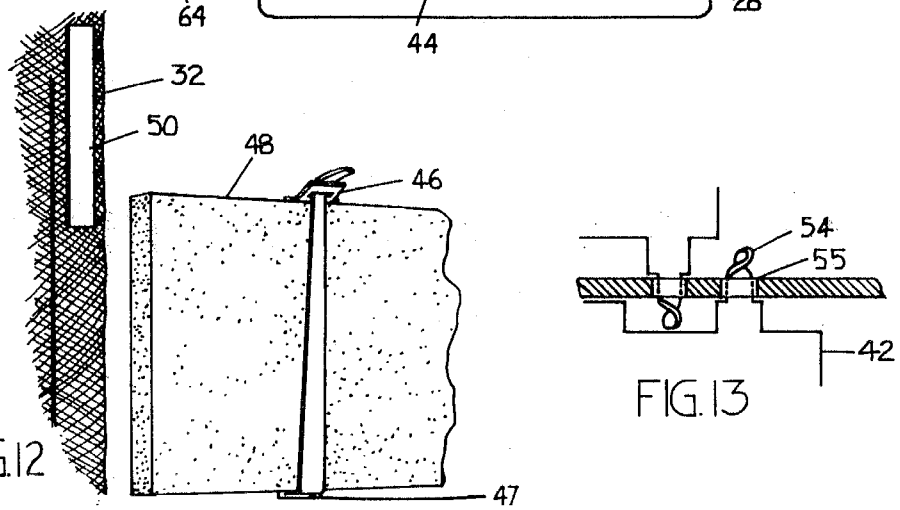
FIG. 13
FIG. 12
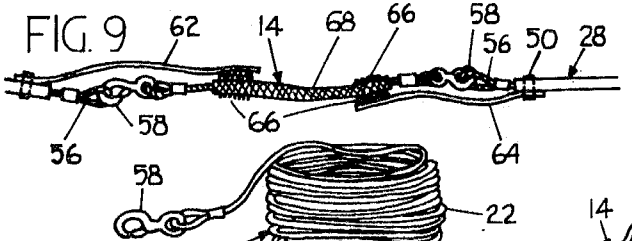
FIG. 9
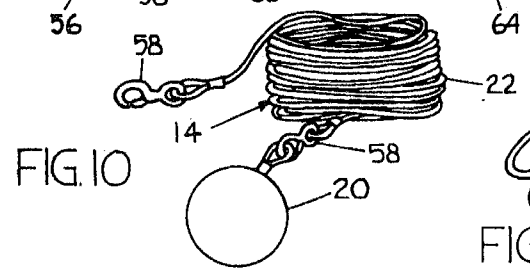
FIG. 10
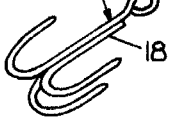
FIG. 11

COMPACTABLE, FOLDABLE, FLOATABLE, BOOM-FENCE TO QUICKLY CONTROL THE SPREAD OF CONTAMINATES OVER WATER SURFACES

BACKGROUND OF INVENTION

As set forth in the background of Millard F. Smith's U.S. Pat. No. 3,564,852 issued Feb. 23, 1971, entitled Flexible Floating Booms, he states booms for confining floating materials have evolved from log booms confining floating logs arriving at a saw mill, and then he discloses his flexible floating boom, primarily deployed as a floating oil boom. His boom has units of a planar fin topped with a cylindrical foam float and ballasted at the bottom, and interconnected with others by a continuous cable located just below the foam float and by excess continuous fin material extending between the units.

Paul Preus and Charles E. Rosendahl in their U.S. Pat. No. 3,579,994 issued May 25, 1971, entitled Barrier for Control of Substances in Bodies of Water, describe and illustrate their barrier centering on an upright flexible skirt having an inflated body along the top and a weighted body along the bottom, with multiple tiered and spaced water ballasting pockets which are both self filling and self bailing. Each barrier unit is secured to an adjacent one by a hinge connection.

Eugene C. Greenwood in his U.S. Pat. No. 3,592,005, entitled Oil Barrier for Offshore Oil Rigs, describes his angularly positioned planar containment units supported by air filled pipe portions and equipped with a top deflector, and joined to others by hinged joints supplemented with flexible sealers.

Murray Risin and Robert Snyder in their U.S. Pat. No. 3,597,924, entitled Floating Oil Barrier and Method of Containing a Floating Substance, describe and illustrate their utilization of expandable and compressible vertical hexagonal barriers made of semirigid metal or plastic segments interconnected with web portions of like material. They are all joined together by a continuous strap or cable, and in the top portions of the hexagonal units there are buoyancy units and in the bottom portions there are ballast units.

Millard F. Smith in another of his U.S. Pat. No. 3,638,430 issued on Feb. 1, 1972, entitled High-Strength Fire-Resistant Spill Control Booms, illustrates and describes the utilization of a continuous flexible fin of a plastic coated knitted wire mesh, foldable upon storage, and when deployed held upright by foamed aluminum blocks secured on both sides of its top portions.

Edmond Flaviani in his U.S. Pat. No. 3,651,647, issued Mar. 28, 1972, entitled Oil Slick Confinement Equipment, discloses his special barrels having hinged panels at one end and recesses at the other end to slidably receive the hinged panel of an adjacent barrel. Each barrel is equipped below with a fin-keel stabilizer, and all barrels are interconnected by using a continuous cable.

Robert K. Thurman in his U.S. Pat. No. 3,751,925, issued Aug. 14, 1973, entitled Floating Oil Containment Boom, and in his U.S. Pat. No. 3,868,824, issued Mar. 4, 1975, entitled Modular Oil Containment Boom, discloses his use of four by eight feet marine plywood panels, each serving as an upright flat barrier and joined to adjacent barriers with a flexible panel and sometimes supplemented with stress bearing chains. All panels have metal drums on each side to acquire buoyancy and all panels have flexible materials weighted inside for ballast secured along their bottom edges. A continuous line joins the panels together.

In summary, these inventors have all realized the need for having barriers which tend to remain upright by using floats and ballast, and maintain the continuity of the barrier by using flexible interconnectors, and sustain overall loadings by using a continuous tension line for interconnecting all of the barriers. Some of them have realized the need for convenient storage, need for foldable units, need for using standard materials, and the need for quick deployment of such overall barriers deployed in inland waters, sounds, and oceans.

SUMMARY OF INVENTION

To create an effective barrier to quickly control the spread of contaminates over water surfaces, a compactable, foldable, floatable boom-fence is provided for quickly, readily, and conveniently launching into the water, via accordian-like folded sections each comprising several panels, attached to like sections, to form an overall boom-fence projecting above and depending below the water surface, thereby quickly and effectively creating a water boom to fence a large water area during the control of a contaminate unwantedly spreading over a surface of water. During such rapid deployment from a stern deck of a boat, from a dock, and/or from a helicopter, there are no delaying operations, such as any requirement to inflate floatation compartments, or to join side by side panels together. Only sections must be quickly joined and generally many sections are prejoined in readiness for deployment. The materials used throughout the boom-fence are readily available, easily worked, assembled, and replaced, and remain substantially planar for compactable and foldable storage, deployment, retrieval, and restorage. At each deployment locale, a starter pack, well identified, contains a substantial length of floating line, a grappling hook, a weighted throwing ball, a reversible flexible coupling and a sea anchor, of a compacted type, opened by movement through the water upon deployment, to create and to maintain the sea anchor shape. This starter pack is attached to any section of panel. All the sections terminate in gates having flexible couplings ready for attaching to other gates, and also having cable end loops and hooks for the quick interconnection of the cables. When like ends of gates of respective sections need to be interconnected, then a reversible, flexible coupling is used.

In a preferred embodiment, each section of the boom-fence has multiple planar rectangular fence panels made of sheet metal. Their tops are folded over and mechanically fastened by crimping to a continuous cable. Each cable has quick interconnectors at the end of each compactable, foldable, floatable, section. The bottoms of each fence panel are equipped with foldable, hinged, oppositely positioned sheet metal dampening fins, held in their active damping positions by stiffleg springs and quickly retracted upwardly and parallel to the rectangular fence panel during the compactable and foldable storage of the boom-fence. Their buoyancy is provided by the adhesive and mechanical, via metal straps, attachment of planar rectangular foam floats, located on both sides and nearer the top than the bottom of each planar rectangular fence panel. The continuity of the boom-fence between panels is undertaken by using flexible couplings made of coated and filled fiberglass cloth, which are secured to the panels by using adhesives and staples. Between sections the centers of these flexible couplings are joined by Velcro fasteners, where the otherwise continuous cables are also quickly joined together and when required are quickly disconnected. Additional sections may be added or removed at any gate, and any gate may be opened to allow the passage of vessels.

DESCRIPTION OF THE DRAWINGS

A preferred embodiment of the compactable, foldable, floatable, boom-fence quickly deployed to control the spreading of contaminates over water surfaces, is illustrated in the drawings, wherein;

FIG. 7, is a partial side elevation of two complete and one partial floatable planar rectangular fence panels deployed in the water, illustrating the joining of sections of the boom-fence by using Velcro fasteners at the midpoint of a flexible coupling, and by using cable loops and hooks with tangs at the midpoint of the otherwise continuous cables extending throughout each section, and upon fastening, extending throughout the length of the boom-fence and showing how the size of a foam float is increased in the gate panels adjacent the flexible coupling which opens via the Velcro fastener;

FIG. 8, is a partial top view of two complete and one partial floatable planar rectangular fence panels deployed in the water, illustrating, as also shown in FIG. 7, the joining of sections of the boom-fence by using Velcro fasteners at the midpoint of a flexible coupling, and by using cable loops and hooks with tangs at the midpoint of the otherwise continuous cables, extending throughout each section and, upon fastening, extending throughout the length of the boom-fence.

FIG. 9, is a top view of a reversible flexible coupling used, when necessary, to join the last panels of adjacent sections, which may have like respective Velcro portions, indicating an additional use of coated and filled fiberglass cloth, Velcro fastener components, and a length of cable with hooks on each end;

FIG. 10, is a perspective view of the floatable line with hooks at each end, which is an accessory provided in the starter pack, attached to a weighted ball, another accessory;

FIG. 11, is a perspective view of a grappling hook which is another accessory provided in the starter pack, and available for use instead of the weighted ball;

FIG. 12, is a partial perspective section of a panel near a flexible coupling, illustrating how the flexible coupling is stapled to the panel, as well as adhesively held, and also showing how the planar rectangular foam floats are strapped to the panel, as well as adhesively held; and FIG. 13, is a partial view illustrating how the dampening fins are hingeably retained on the panels, as their tabs are first inserted through slots in the bottom of the panels and then twisted to prevent their withdrawal.

DESCRIPTION OF THE PREFERRED EMBODIMENT

Figure 1:
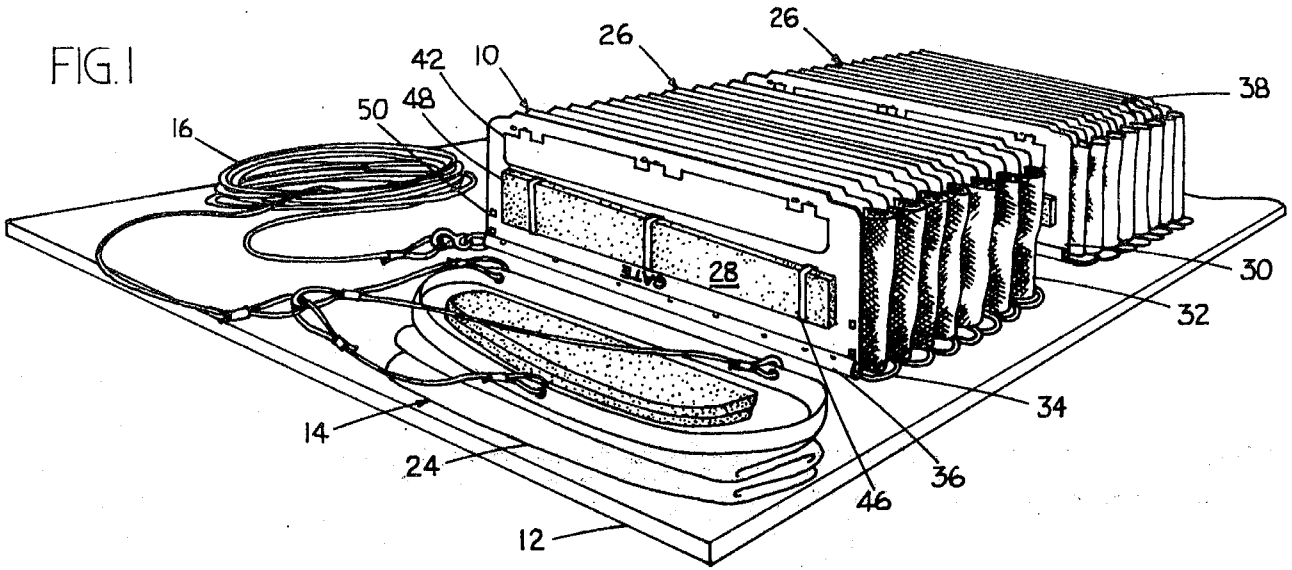
FIG. 1, is a perspective view of a starter pack and follow on sections of the boom-fence compactly folded on a planar structure such as a dock, or boat deck, awaiting a quick, ready, convenient launching illustrating the planar rectangular fence panels of the sections, with their folded dampening fins, their foam floats, and their connecting foldable, flexible couplings, the continuous cable, and also the starter accessories, such as the floating line, grappling hook, weighted throwing ball, and sea anchor.

A preferred embodiment of the compactable, foldable, floatable, boom-fence 10 is illustrated throughout the drawings. In FIG. 1, ready for deployment and arranged on a platform 12, is a starter pack 14, for use with a first fence panel of a section 26, i.e. a gate panel 28 comprising selected accessories such as a floating line 16, a grappling hook 18 or a weighted throwing ball 20 for attachment to light, often floatable line 22, and a sea anchor 24, shown folded, which opens upon movement through the water. Each section 26, comprises several planar rectangular fence panels 30 and two gate panels 28 secured together by flexible coupling panels 32 to continue the fencing, and by a continuous cable 34. Each planar rectangular fence panel 30, shown inverted in FIG. 1, has a top 36 formed to encompass portions of the continuous cable 34 and be held to the cable 34 by crimped portions 37, and a bottom 38 to receive hinges 40, in turn receiving dampening fins 42 folded adjacent to the fence panel during storage, and held outwardly at right angles during the deployment of the boom-fence 10, and so held by stiffleg springs 44. Also on both sides of each planar rectangular fence panel 30 are rectangular foam floats 48 positioned nearer the top than the bottom to provide floatation. Generally, the planar rectangular fence panels 30 and the dampening fins 42 are made of sheet metal to provide the ballast along with the cable 34. If lighter materials were used specific ballast would be necessary.

Figure 2:
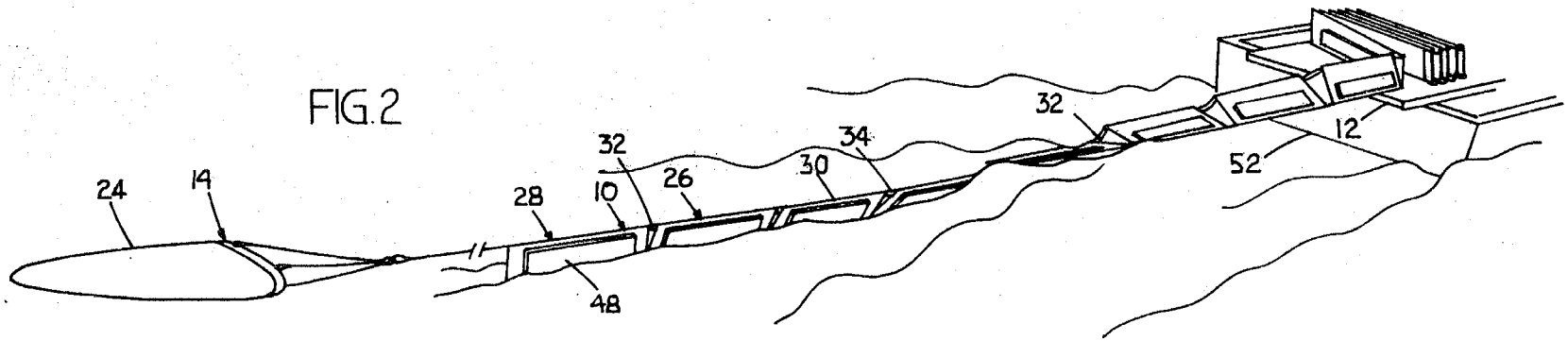
FIG. 2, is a perspective view of the commencing deployment of the boom-fence from the stern of a boat illustrating the utilization of the sea anchor, and the unfolding of the compactable, foldable, and floatable, planar rectangular fence panels of the sections.

The deployment of the compactable, foldable, floatable, boom-fence 10 from the stern of a boat 52 using a sea anchor 24 is illustrated in FIG. 2. Each planar rectangular fence panel 30 with the rectangular foam floats 48 and each of the gate panels 28 quickly assumes the boom-fence upright attitude. As necessary in reference to a large surface area, other boats 52 will also deploy a stern deck load of sections 26 and an encircling or surrounding boom-fence 10 will be completed, with the connections between sections 26 being quickly and readily undertaken.

Figure 3:
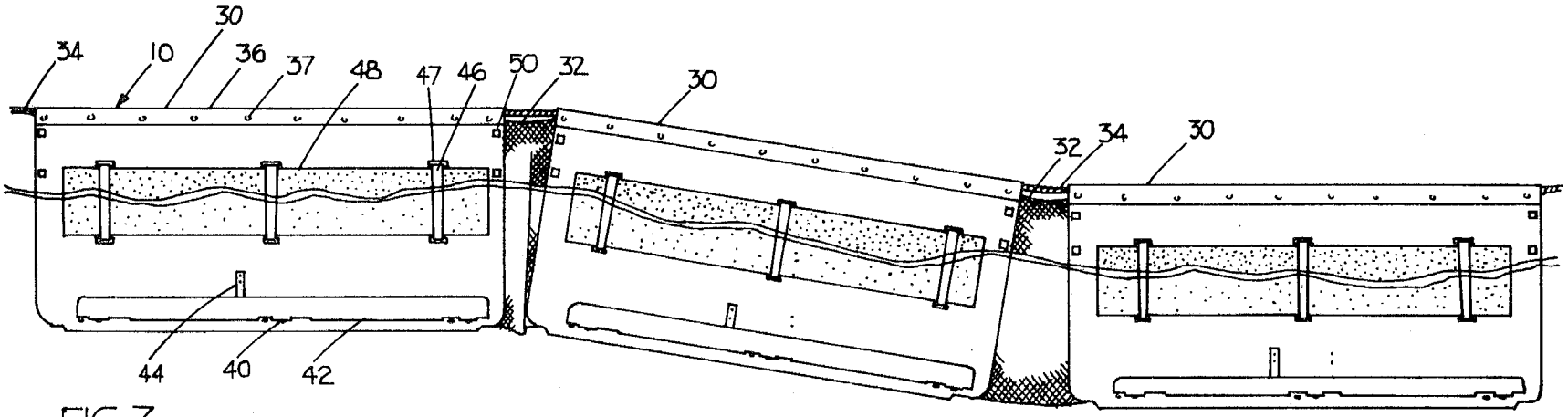
FIG. 3, is a partial side elevation of three floatable planar rectangular fence panels deployed in the water and undergoing wave motions, as indicated both by the water line and the relative movements of the panels and their flexible couplings and the continuous cable.
Figure 4:
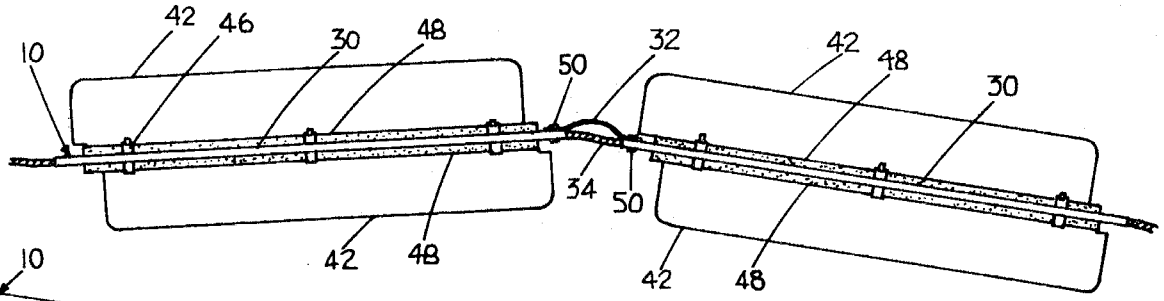
FIG. 4, is a partial top view of two floatable planar rectangular fence panels deployed in the water and undergoing relative angular movement, indicating the horizontal positioning of the dampening fins and the movement of the flexible coupling and the continuous cable.

As illustrated in FIGS. 3 and 4, the deployed boom-fence 10 ably responds to wave motions and maintains the continuity of the fence. In the vertical or elevational view of FIG. 3 the angular tilting up and down of the planar rectangular fence panels 30 is depicted. As the space between the ends of these fence panels 30 varies in distance and shape, the flexible coupling panels 32 continue to maintain the continuity of the boom-fence 10. In this preferred embodiment, a coated and filled fiberglass cloth serves as the flexible coupling panel 32. Waterproof adhesives and mechanical fastenings such as staples 50 are used to form these flexible coupling panels 32 to the planar rectangular fence panels 30. Waterproof adhesives and metal straps 46, passed through slots 47 and interlocked, are used to join the rectangular foamed floats 48 to these fence panels 30, and also the gate panels 28.

In the top view of FIG. 4, the angular left and right movements of the planar rectangular fence panels are illustrated indicating the flexibility of the flexible coupling panels 32 and also the flexibility of the continuous cable 34, which solely assumes the tensional loading of the overall boom-fence 10, and thereby protects the flexible coupling panels 32 from such tensional loading.

Figure 6:
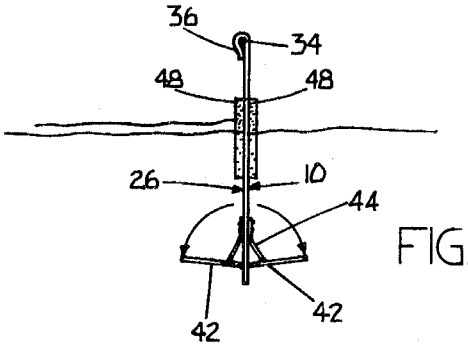
FIG. 6, is a cross-sectional view of one floatable planar rectangular fence panel, illustrating the top folded over the continuous cable, the opposite side rectangular foam floats, the opposite side deployed dampening fins held in place by respective stiffleg springs, with the respective oil and water lines indicated nearer the top of the fence panel.
Figure 5:
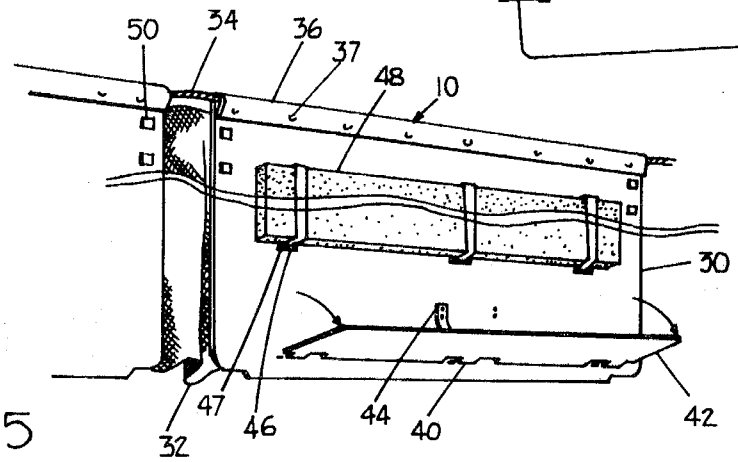
FIG. 5, is a perspective view of one complete floatable planar rectangular fence panel and a portion of an adjacent one, a flexible coupling joining them to complete the fence, the folded over top which is mechanically attached by crimping to the cable, a rectangular foam float adhesively secured and also held by metal straps, and the hinged dampening fin held in the active position by a stiffleg spring.

In FIGS. 3, 4, and especially in FIGS. 5 and 6 the outward positioning of the dampening fins 42 is illustrated, after their rotation about their hinges 10, and retention by the stiffleg springs 44. During the up and down, and tilting movements of the fence panels 30, the resistive forces created by these dampening fins 42 tend to reduce the overall otherwise adverse effects of the wind and the wave motion energy upon these fence panels 30, by specifically resisting the tilting and providing drag to resist down wind movement of the total boom-fence.

With respect to the quick and reliable joining of sections 26 of the boom-fence 10, FIGS. 7 and 8 illustrate the interconnection of the otherwise continuous cables 34 by using cable loops 56 and hooks 58 with tangs 60, and also the interconnection of the half portions 62, 64 of a flexible coupling panel 32 by using Velcro fasteners 66. Both these interconnections are quickly and conveniently undertaken, so as many sections, as may be needed in any particular water surface location may be quickly deployed to create the overall boom-fence 10. As indicated in FIG. 7, the fence panels 30 adjacent the connections of the sections 26 will be marked with the word, Gate, to designate the connection location.

FIG. 9 is a top view of a reversible flexible coupling 68 inclusive of a section of cable 34 with hooks 58 at each cable end, Velcro fasteners 66 and the coated fiberglass cloth. This reversible flexible coupling 68 is attached to adjacent flexible coupling portions 32 of adjacent gate panels 28. When a large boom-fence 10 is being quickly deployed, the final gate panels 28 of respective sections 26 may have like Velcro components, i.e. both hooks, or both loops. When this occurs, the reversible flexible coupling 68 is used in joining the adjacent respective sections together. A starter pack 14 contains a reversible flexible coupling 68.

In respect to the starter pack 14, FIGS. 10 and 11 illustrate how the light often floatable line 22, equipped with hooks 58 at each end, is selectively used either with the throwing ball 20, or the grappling hook 18.

FIG. 12 is a partial perspective view of a fence panel 30 and an adjacent flexible coupling panel 32, to illustrate the metal staple 50 attachment of flexible coupling panel 32 to fence panel 30, and metal strap 46 attachment of foamed float 48 to fence panel 30. In addition waterproof adhesives are also used in both places.

FIG. 13 is a partial top view of the self contained, i.e. integral, hinge 40 attachment of dampening fins 42 to fence panels 30, or gate panels 28. Integral projections 54 on dampening fins 42, are passed through slots 55 in the fence or gate panels, 30 or 28, and then twisted to retain the fins 42 and panels, 30 or 28 together.

The construction and assembly features indicated in views 12 and 13, and throughout the drawings, indicate how the boom-fence is reliably made from readily available materials at comparatively lower costs, while still maintaining all of the objectives of a compactable, foldable, floatable, continuous, boom-fence for quick and ready launching and deployment to control a contaminate otherwise unwantedly spreading over a surface of water. Also throughout the boom-fence, materials, fasteners and their utilization are made fire resistant or are inherently fireproof. Therefore, if the contaminates being controlled are burnable and become ignited, the continuity of the boom-fence 10 will not be destroyed by fire.

Moreover, the boom-fence 10 has sufficient flexibility to withstand many forces that otherwise might cause fatigue stresses. The flexible coupling panels 32 have coated fiberglass cloth portions arranged, so their non-attachment portions are in a trapezoidal shape, in elevation, being in one embodiment, 5 inches across the top, and 8 inches across the bottom. Yet at both sides there is a 1" overlap of this material, where the attachment is undertaken to the panels 28 or 30.

We claim:

1. A compactable, foldable, floatable, continuous boom-fence quickly deployable to control the spreading of contaminates over water surfaces, comprising multiple planar fence panels; each multiple planar fence panel having a top portion formed about and attached to a continuous cable extending throughout all fence panels and between all adjacent planar fence panels, each multiple planar fence panel having a slotted bottom portion with the slots staggered horizontally to accept projections of dampening fins located on each side, each multiple planar fence panel having dampening fins with their projections inserted through the slots of the bottom portion and then their outer portions of the inserted projections are twisted to a right angle thus creating a limited hinging action, whereby the dampening fins are either folded parallel to the planar fence panel for compactness or are deployed to their approximate right angle position, and each dampening fin is notched to allow clearance for the twisted outer portions of the inserted projections of the opposite dampening fin, each multiple planar fence panel having positioners consisting of stiffleg springs, which deploy and lock into position upon the full opening of the dampening fins, keeping the dampening fins hinged at right angles on both sides of each planar fence panel, and the opening of the dampening fins is accomplished by action in the water or by gravity and thereafter the stiffleg springs maintain the fins in an open position on both sides of each planar fence panel, each multiple planar fence panel having an upper middle portion having in turn planar floats consisting of a foamed material of a density of approximately four pounds per cubic foot and of a sufficient volume to provide adequate buoyancy to support the wetted weight of the entire planar fence panel and to provide freeboard of approximately $\frac{1}{3}$ of the height of the panel to extend above the mean water line by $\frac{1}{4}$ of the volume of the float and be equally distributed from end to end, such additional buoyancy complements the functioning of the dampening fins; and each multiple planar fence panel having flexible couplings extending to adjacent planar fence panels consisting of woven fiberglass cloth impregnated with fortified silicone rubber.

2. A compactable, foldable, floatable, continuous boom-fence, as claimed in claim 1, wherein multiple planar fence panels are arranged in sections and between sections, the flexible couplings have Velcro fasteners at their midsections, and the otherwise continuous cables have cable loops and hooks with tangs as fasteners at their midpoint.

3. A compactable, foldable, floatable, continuous boom-fence, as claimed in claim 2, wherein any section before being coupled to other sections has added to its then first multiple planar fence panel a starter pack of selected deployment accessories, comprising a floating line, a grappling hook, a weighted throwing ball, a light line attachable to the hook or ball, and a sea anchor.

4. A compactable, foldable, floatable, continuous boom-fence, as claimed in claim 1, wherein the planar fence panels are made of sheet metal thereby constituting partial ballast.

5. A compactable, foldable, floatable, continuous boom-fence, as claimed in claim 4, wherein the planar floats consist of a foamed material of a density of approximately four pounds per cubic foot, such as polyurethane foam.

6. A compactable, foldable, floatable, continuous boom-fence, as claimed in claim 5, wherein the dampening fins are constructed of sheet metal, thereby constituting additional ballast, and serving to dampen vertical oscillations from wave action and to resist drift caused by wind action.

7. A compactable, foldable, floatable, continuous boom-fence, as claimed in claim 1, wherein the flexible couplings are coated fiberglass cloth of a trapezoidal shape.

8. A compactable, foldable, floatable, continuous boom-fence, as claimed in claim 4, wherein the planar fence panels are rectangular sheet metal panels.

9. A compactable, foldable, floatable, continuous boom-fence, as claimed in claim 5, wherein the planar floats are of a rectangular shape.

10. A compactable, foldable, floatable, continuous boom-fence, as claimed in claim 9, wherein the rectangular planar floats are adhesively and mechanically secured to the planar fence panels.

11. A compactable, foldable, floatable, continuous boom-fence, as claimed in claim 3, wherein the starter pack of selected deployment accessories are removed from the then first multiple planar fence panel of what then was a first section of a continuous boom-fence, and are added to the then last multiple planar fence panel of the then last section, thereby making this continuous boom-fence re-deployable from this last multiple planar fence panel.

12. A compactable, foldable, floatable, continuous boom-fence, as claimed in claim 11, where two lines of sections are deployed with an opposite lay resulting in their end Velcro fasteners being alike, both hooks or both loops, then they are connected together using a reversible flexible coupling having double hooks and two way Velcro fastener components.

13. A compactable, foldable, floatable, continuous boom-fence, as claimed in claim 1, wherein the flexible couplings are adhesively and mechanically attached to the planar panels.

14. A compactable, foldable, floatable, continuous boom-fence quickly deployable to control the spreading of contaminates over water surfaces, comprising:

(a) multiple boom-fence panels, each having:
  (1) a planar metallic rectangular body for upright positioning relative to the surface of the water with portions located both above and below the water surface,
  (2) planar floats secured to each side of the planar metallic rectangular body to maintain its upright positioning with portions located both above and below the water surface;
  (3) planar metallic dampening fins foldably secured to the planar metallic rectangular body to be during deployment below the surface of the water to maintain the upright position;
  (4) a continuous surrounding integral metallic receiver at the top of the planar rectangular body to receive a continuous joining member extending beyond to other boom-fence panels.

(b) continuous multiple boom-fence flexible couplings, each used between boom-fence panels to accommodate relative changing positions thereof, while continuing the continuity of an entire boom-fence, having:
  (1) a coated fiberglass cloth impregnated with fortified silicone rubber extending between and beyond adjacent boom-fence panels; and
  (2) fasteners to secure the fiberglass cloth to adjacent boom-fence panels; and (c) centrally detachable boom-fence flexible couplings, each used between boom-fence panels, which are to be conveniently connected and separated during use, to accommodate such connections and separations and to continue to accommodate, when connected, relative changing positions of the boom-fence panels, while continuing the continuity of the entire boom-fence, having:
  (1) coated fiberglass cloth impregnated with fortified silicone rubber in two portions to be releasibly joined together at their overall midsection and, when joined, extending between and beyond adjacent boom-fence panels;
  (2) fasteners to secure the respective two portions of this coated fiberglass cloth to adjacent boom-fence panels; and
  (3) a joining member section with fasteners, at respective ends, to join together at their midsection the coated fiberglass cloth impregnated with fortified silicone rubber extending from adjacent boom-fence panels.

15. A compactable, foldable, floatable, continuous boom-fence, as claimed in claim 14, wherein the materials used are respectively fireproof and fire resistant.

16. A compactable foldable, floatable, continuous boom-fence, as claimed in claim 14, wherein the multiple boom-fence flexible couplings, are in a trapezoidal shape, in elevation, providing more flexure.

17. A boom-fence panel used with others to stop the unwanted spreading of contaminates over the surface of water, comprising:

(a) planar metallic rectangular body for upright positioning relative to the surface of the water with portions located both above and below the water surface;

(b) planar floats secured to both sides opposite one another, of the planar metallic rectangular body to maintain its upright positioning with portions located both above and below the water surface;

(c) planar metallic dampening fins foldably secured near the bottom of each side of the planar metallic rectangular body to be during deployment below the surface of the water to maintain the upright position;

(d) a continuous surrounding integral metallic receiver at the top of the planar metallic rectangular body to receive a continuous joining member extending beyond to other boom-fence panel; and (e) stiffleg springs secured to each side of the planar metallic rectangular body, which deploy and lock into position the planar metallic dampening fins, upon their full opening to a right angle position with respect to the planar metallic rectangular body.

* * * * *